US005578992A

United States Patent [19]

Harding

[11] Patent Number: 5,578,992

[45] Date of Patent: Nov. 26, 1996

[54] PERSONAL SAFETY ALARM AND TIMEKEEPING DEVICE

[76] Inventor: Montgomery G. B. Harding, 3 Stark Ct., Princeton Woods, Newark, Del. 19702

[21] Appl. No.: 529,447

[22] Filed: Sep. 18, 1995

[51] Int. Cl.[6] ..... G08B 13/00

[52] U.S. Cl. ..... 340/574; 340/321; 340/691; 340/693; 361/232; 362/102; 362/253; 368/10

[58] Field of Search ..... 340/321, 573, 340/574, 691, 692, 693; 368/10; 362/102, 253; 361/232

[56] References Cited

U.S. PATENT DOCUMENTS

| | | | |
|---|---|---|---|
| 4,703,402 | 10/1987 | Hsieh | 362/102 |
| 4,731,604 | 3/1988 | Pawlowski, Jr. | 340/574 |
| 4,835,665 | 5/1989 | Kao | 362/184 |
| 4,842,227 | 6/1989 | LaCroix | 361/232 |
| 5,001,462 | 3/1991 | Seemann et al. | 340/574 |
| 5,032,824 | 7/1991 | Corbin | 340/574 |
| 5,075,671 | 12/1991 | Livingston, III | 340/574 |
| 5,086,377 | 2/1992 | Roberts | 362/102 |
| 5,318,177 | 6/1994 | Isacson | 362/253 |
| 5,392,029 | 2/1995 | Chang | 340/574 |

*Primary Examiner*—Brent A. Swarthout
*Assistant Examiner*—Daniel J. Wu
*Attorney, Agent, or Firm*—Sean F. Sullivan; David L. Baker; Rhodes & Ascolillo

[57] ABSTRACT

A personal safety alarm device, including a main housing, and a light source maintained within the housing. An audio alarm speaker is located on an outside surface of the housing, along with a pair of high voltage electrodes located on the top surface of the main housing. In addition, the device features a timekeeping device including a DC powered oscillator, memory unit, and associated display device therewith. There is a high voltage generating circuit within the housing which is coupled to the electrodes. Finally, an alarm triggering circuit has an alarm switch which, when activated, causes both the light source to flash intermittently and the audio alarm speaker to sound intermittently. The high voltage generating circuit produces, at the pair of high voltage electrodes, a voltage capable of delivering a stunning electric shock to an assailant. Electric power to the oscillator is interrupted whenever said alarm switch is activated, thereby "recording" the time of such activation, and this time is still displayed since the memory unit of the timekeeping device is supplied with DC power independently from the oscillator.

5 Claims, 2 Drawing Sheets

PERSONAL SAFETY ALARM AND TIMEKEEPING DEVICE

BACKGROUND OF THE INVENTION

1. Field of the Invention

The present invention relates generally to a personal safety alarm and timekeeping device and, more particularly, to such a device capable of delivering an electric shock to an assailant, as well as recording and displaying the time of a physical attack.

2. Description of the Related Art

U.S. Pat. No. 4,835,665 issued to Kao relates to an energy flashlight having a compass and detection box having an auxiliary battery. When activated, the auxiliary battery causes a sounder to be activated while simultaneously causing the lamp portion to emit short bursts of light.

U.S. Pat. No. 5,075,671 issued to Livingston III discloses a personal alarm system incorporating an audio alert that, when activated, is unable to be removed from the user or deactivated without the cooperation of the user.

U.S. Pat. No. 4,731,604 issued to Pawlowski, Jr. discloses a portable hand held distress signal device featuring a casing member for receiving dry cell batteries therein. The casing has positive and negative terminals connected in series with an on/off switch, along with a dome member of plastic transparent material.

U.S. Pat. No. 5,001,462 issued to Seemann et al. discloses a personal safety alarm and light device which may be worn by a user or attached directly to a handbag or purse.

U.S. Pat. No. 4,703,402 issued to Hsieh discloses a flashlight with an alarm having a transparent hood at the front end, and also featuring retractable electrodes capable of delivering electric shock.

Personal safety and alarm devices are previously well known in the art. However, it is always possible that such devices will fail to attract help or ward off an attacker in the event of an abduction or kidnapping. If the victim should happen to be taken and subsequently loses possession of the safety device, it is important to leave authorities with as many clues as possible. One source of valuable information to authorities would be the exact time of the abduction. A need, therefore exists, for a safety device which, if unsuccessful in thwarting an attack, will record the time of such attack.

SUMMARY OF THE INVENTION

Accordingly, it is a principal object of the present invention to provide a personal safety alarm device which, when activated by the owner will produce a loud, intermittent noise as well as an intermittent light flash.

It is another object of the invention to provide such a device which also functions as a defensive weapon by producing a voltage capable of delivering an electric shock to an assailant It is still another object of the invention to provide a time keeping device which is recorded and displayed whenever the alarm features of the device are activated.

The present invention achieves the above objects, among others, by providing a personal safety alarm device, including a main housing, and a light source maintained within the housing. An audio alarm speaker is located on an outside surface of the housing, along with a pair of high voltage electrodes located on the top surface of the main housing. In addition, the device features a timekeeping device including a DC powered oscillator, memory unit, and associated display device therewith. There is a high voltage generating circuit within the housing which is coupled to the electrodes. Finally, an alarm triggering circuit has an alarm switch which, when activated, causes both the light source to flash intermittently and the audio alarm speaker to sound intermittently. The high voltage generating circuit produces, at the pair of high voltage electrodes, a voltage capable of delivering a stunning electric shock to an assailant. Electric power to the oscillator is interrupted whenever said alarm switch is activated, thereby "recording" the time of such activation, and this time is still displayed since the memory unit of the timekeeping device is supplied with DC power independently from the oscillator.

These and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 1:
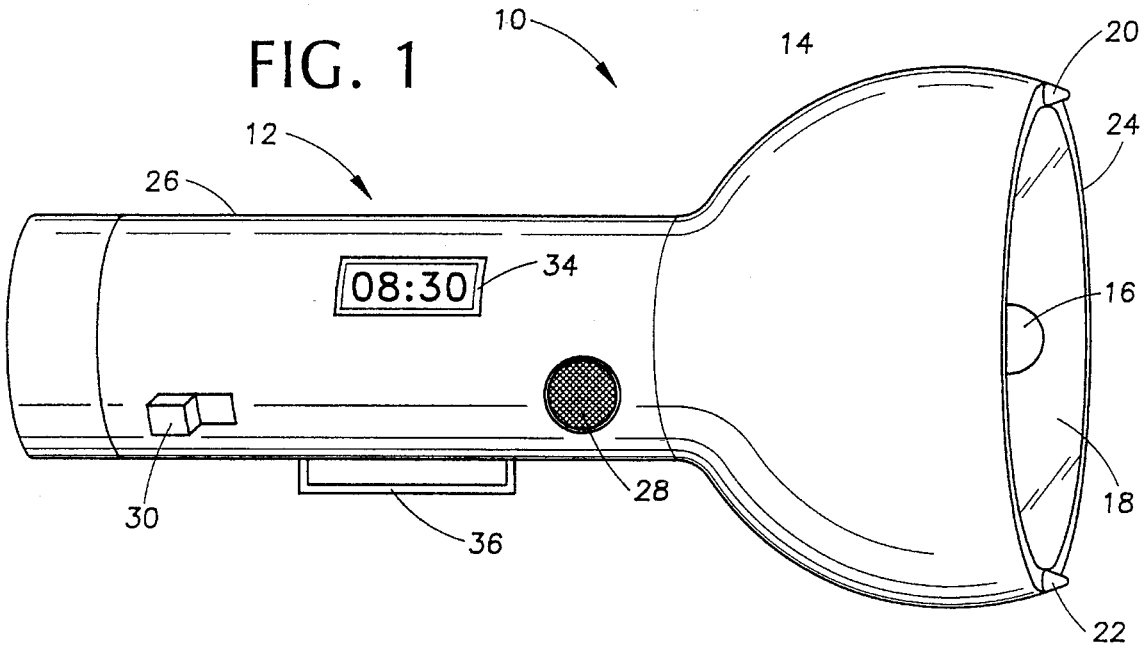
FIG. 1 is a perspective view of the personal safety alarm device according to the present invention.

Referring initially to FIG. 1, there is shown a personal safety alarm device generally designated by the reference numeral 10. Device 10 has a main housing 12 which features an enlarged, rounded portion 14 at one end which gives device 10 the appearance of an ordinary flashlight. Located within the rounded portion 14 of the housing is a light source 16 which is protected by a transparent cover 18. A pair of high voltage electrodes 20, 22 are included on the outer circumference 24 of housing 12. The electrodes 20, 22 are designed to deliver a stunning jolt of current when used in the alarm mode, the function of which will be described hereinafter.

The neck or body 26 of the device 10 features an audio alarm speaker 28 which produces an intermittent beeping to signal that the user is in danger. The speaker 28 is activated by an alarm switch 30, also located on the neck 26 of the device 10. A timekeeping device 32 is provided internally and has a digital display 34 functioning as a clock for the user. The timekeeping device 32 is designed to act as a recording mechanism whereby in the event of an emergency or assault, the time is stopped and remains displayed whenever alarm switch 30 is activated. Finally, a belt loop 36 is provided on the outside of the housing 12, giving the user the option of wearing it on his or her person by passing a belt (not shown) therethrough.

Figure 2:
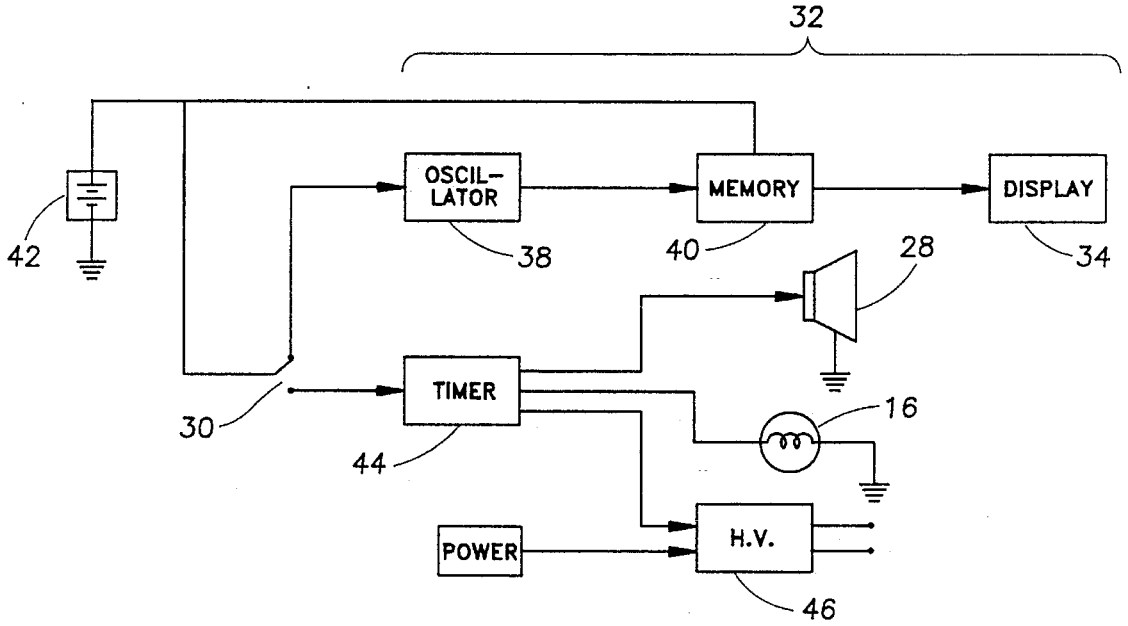
FIG. 2 is a block diagram which illustrates the alarm switching sequence and related functions of the present invention.

The operating characteristics of the device are best understood by reference to the block diagram of FIG. 2. The alarm switch 30 is shown connected to an oscillator 38 or other suitable device for keeping time. A memory unit 40 has its input connected to the output of the oscillator 38 but at the same time is independently connected to a DC power source 42. Thus, when alarm switch 30 is moved from its "normal position" to the "alarm position", the oscillator 38 is deactivated while the memory 40 and display 34 units remain powered, thereby effectively recording the exact time the alarm condition occurs.

Figure 3:
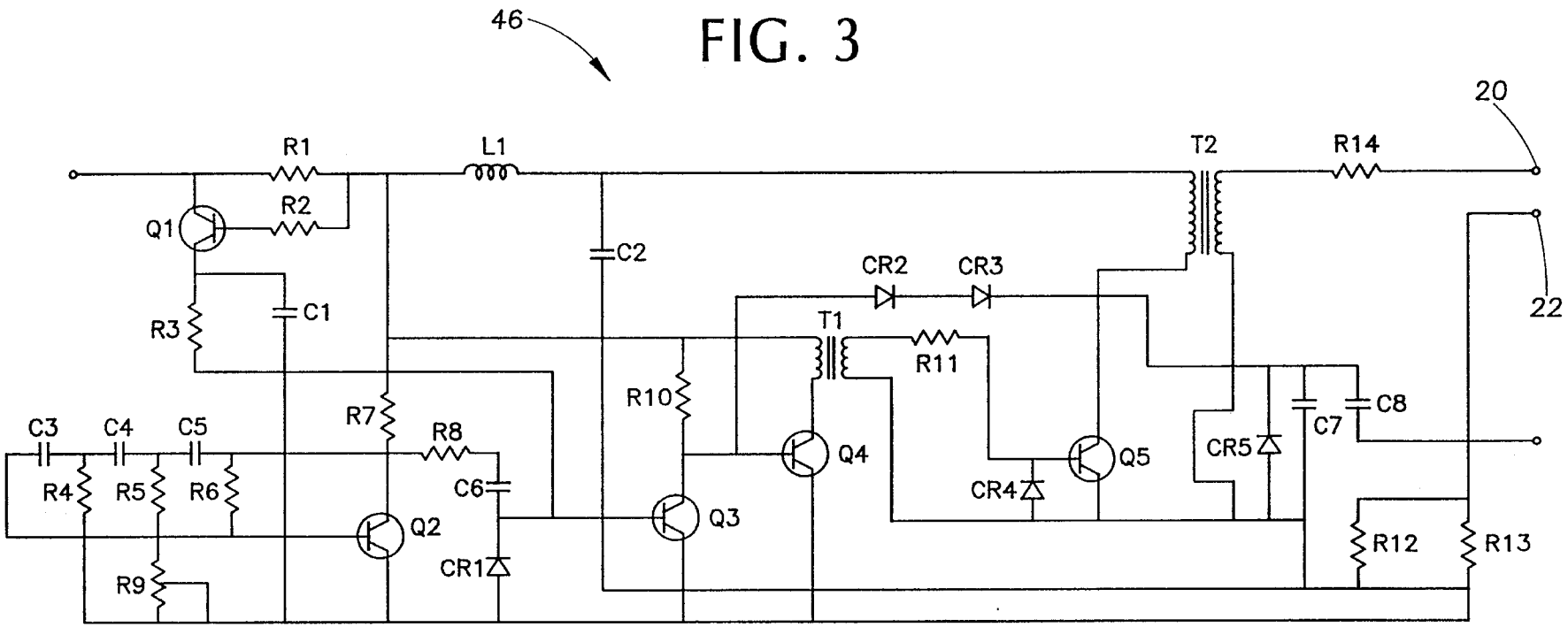
FIG. 3 is a schematic diagram illustrating the high voltage generating circuit according to the present invention.

Once in the alarm position, alarm switch 30 activates a timer circuit 44 which, in turn, sends intermittent pulses to the alarm speaker 28 and light source 16, causing intermittent buzzing and flashing of the speaker 28 and light source 16, respectively. At the same time, timer circuit 44 activates a high voltage generating circuit 46 (FIG. 3) which produces a voltage at electrodes 20, 22, sufficient enough to stun an assailant, thus allowing the device 10 to function as a defensive weapon as well as an emergency signaling device. In the event of an abduction of the user by the assailant, and in the event the device 10 is dropped by the user, the time of the assault remains displayed, thereby providing important information to authorities.

Finally, the device 10 is returned to a normal mode of operation by moving the alarm switch to its "normal" position. The device 10 is preferably provided with clock resetting mechanisms (not shown), such as time input buttons, which are well known in the art.

It will thus be seen that the objects set forth above, among those elucidated in, or made apparent from, the preceding description, are efficiently attained. Since certain changes may be made in the above construction without departing from the scope of the invention, it is intended that all matter contained in the above description or shown on the accompanying drawing shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A personal safety alarm device, comprising:

a main housing;

a light source included within the housing;

an audio alarm speaker disposed on an outside surface of the housing;

a timekeeping device and associated display therewith, said display located on the outside surface of the main housing; and an alarm triggering circuit which further comprises an alarm switch, said switch, when activated, causing said audio alarm speaker to sound intermittently, and further causing said light source to flash intermittently; with said timekeeping device being deactivated whenever said alarm switch is activated, and said display associated with said timekeeping device remaining activated, thereby displaying the time which said alarm switch is activated.

2. The personal safety alarm device as described in claim 1, wherein said timekeeping device further comprises:

an oscillating device coupled to a DC power source;

a memory device having an input coupled to the output of said oscillating device; and said display device connected to the output of said memory device;

said memory device further being directly connected to said DC power source, independently from said oscillating device.

3. A personal safety alarm device, comprising:

a main housing;

a light source maintained within said housing;

an audio alarm speaker on an outside surface of said housing;

a timekeeping device comprising a DC powered oscillator, memory unit, and associated display device therewith;

a pair of high voltage electrodes located on a top surface of said main housing;

a high voltage generating circuit within said housing which is coupled to said electrodes; and an alarm triggering circuit comprising an alarm switch which, when activated, causes:

said light source to flash intermittently;

said audio alarm speaker to sound intermittently;

said high voltage generating circuit to produce, at said pair of high voltage electrodes, a voltage capable of delivering a stunning electric shock to an assailant.

4. The personal safety alarm device as described in claim 3, wherein power to said oscillator is interrupted whenever said alarm switch is activated.

5. The personal safety alarm device as described in claim 4, wherein said memory unit of said timekeeping device is supplied with DC power independently from said oscillator.

* * * * *